US006715756B2

(12) United States Patent
Inoue

(10) Patent No.: US 6,715,756 B2
(45) Date of Patent: Apr. 6, 2004

(54) SYMBOL DISPLAY DEVICE FOR GAME MACHINE

(75) Inventor: Haruo Inoue, Tokyo (JP)

(73) Assignee: Dragon Co., Ltd., Tokyo (JP)

( * ) Notice: Subject to any disclaimer, the term of this patent is extended or adjusted under 35 U.S.C. 154(b) by 12 days.

(21) Appl. No.: 10/278,973

(22) Filed: Oct. 24, 2002

(65) Prior Publication Data

US 2004/0000754 A1 Jan. 1, 2004

(30) Foreign Application Priority Data

Jun. 26, 2002 (JP) ..... 2002-185493

(51) Int. Cl.[7] ..... A63B 71/00

(52) U.S. Cl. ..... 273/143 R; 273/142 R; 273/138.1; 273/138.2; 463/16; 463/20

(58) Field of Search ..... 273/143 R, 138.2, 273/274; 463/20, 16

(56) References Cited

U.S. PATENT DOCUMENTS

| | | | | |
|---|---|---|---|---|
| 4,844,467 A | | 7/1989 | Gyenge et al. | |
| 5,152,529 A | * | 10/1992 | Okada | 463/20 |
| 5,462,277 A | | 10/1995 | Takemoto | |
| 5,722,891 A | * | 3/1998 | Inoue | 463/20 |
| 6,059,658 A | | 5/2000 | Mangano et al. | |
| 6,398,220 B1 | * | 6/2002 | Inoue | 273/142 R |
| 6,612,575 B1 | * | 9/2003 | Cole et al. | 273/138.1 |
| 6,623,006 B2 | * | 9/2003 | Weiss | 273/138.2 |

FOREIGN PATENT DOCUMENTS

| | | |
|---|---|---|
| GB | 2 268 415 A | 1/1994 |
| WO | 94/19780 | 9/1994 |
| WO | 02/04080 A1 | 1/2002 |

* cited by examiner

*Primary Examiner*—Derris H. Banks
*Assistant Examiner*—Dmitry Suhol
(74) *Attorney, Agent, or Firm*—Young & Thompson

(57) ABSTRACT

A slot machine includes a rotatable reel which is cylindrical shaped. The reel is provided with a first display portion on a side surface and with a second display portion on a periphery. In performing a first game, the side surface is so perpendicular that the first display portion may be observable. In performing a second game, the periphery is so horizontal that the second display portion may be observable.

13 Claims, 7 Drawing Sheets

SYMBOL DISPLAY DEVICE FOR GAME MACHINE

BACKGROUND OF THE INVENTION

1. Field of the Invention

The present invention relates to a symbol display device for a game machine that includes plural symbol display members used for performing plural games.

2. Description Related to the Prior Art

In a slot machine, there are a reel type and a video type. In the reel type slot machine, plural ratatable reels are disposed side by side, and each of the reels carries plural symbols. In the video type, the slot machine simulates the movement of the reel and displays it on a display, such as a CRT and the like. In order to perform the slot game with the slot machine, the coin (including a medal and token) is inserted, and thereafter the start lever is operated. When the start lever is operated, the symbol arrays start moving. In the slot machine having a stop button, when the stop button is operated, each of the symbol arrays stop moving. Further, in the slot machine of the automatic-stop type, after a random time passes, each of the symbol arrays stops moving. Thus on each winning line the plural symbols construct a symbol combination. When the symbol combination is the same as that for winning, a player wins the game and obtains a predetermined prize.

A slot machine including another symbol display device for performing a subsidiary game is also known as the symbol display device for the slot game that is mentioned above. In this slot machine, when the player wins the slot game, a dividend determining game is performed as the subsidiary game for determining a number of dividend coins to be discharged. The symbol display device for the subsidiary game is rotatably provided with a disk-like display member, on which several numbers are recorded. In the dividend determining game, when the display member stops after rotation for a predetermined time, the number corresponding to an index is determined as a number of the dividend coins.

In most of the slot machines, the number of the dividend coins is determined in accordance with the symbol combination for winning. For example, when the predetermined symbol combination, such as "7-7-7", is completed on the winning line, the number of the dividend coins becomes extremely large. In this type of slot machine, a double-up game can be performed as the subsidiary game in order to increase the number of the dividend coins. The double-up game is performed automatically or optionally when the player wins the slot game in a predetermined condition. In the double-up game, the number on the display member that is pointed by the pointer after stop of rotation is determined as a multiplier to the number of the dividend coins. Accordingly as the player has more opportunities to obtain the large number of dividend coins, the player can have more interests for the game. Further, when the symbol display device for the subsidiary game is disposed in the upper side of the slot machine, the contents of the game are easily known to other players.

However, the display member can display only one kind of contents, such as the number of the dividend coins, the multiplier or the like. Accordingly, the subsidiary game is monotonic, and therefore does not sufficiently attract the player.

SUMMARY OF THE INVENTION

An object of the present invention is to provide a symbol display device including a display member for performing plural games.

Another object of the present invention is to provide a symbol display device that can make a large visual impact on the player In order to achieve the objects, a symbol display device of the present invention includes a display member rotated by a rotation drive means and a shift means for shifting the display member between a first position and a second position. The display member has a first display portion carrying first symbols and a second display portion carrying second symbols. When the display member is in the first position, the first symbols on the first display portion are observable so as to perform a first game. When the display member is in the second position, the second symbols on the second display portion are observable so as to perform a second game.

In the preferable embodiment of the present invention, the display member is a cylindrical reel. A side surface thereof is a first display portion and a periphery thereof is a second display portion.

According to the invention, as the display member is shifted between the first and second display positions, the plural games can be independently performed even by using the one display member, and variations of the game becomes more. Further, as the display member shifts, the symbol display device can become more attractive as the display member is shifted.

BRIEF DISCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
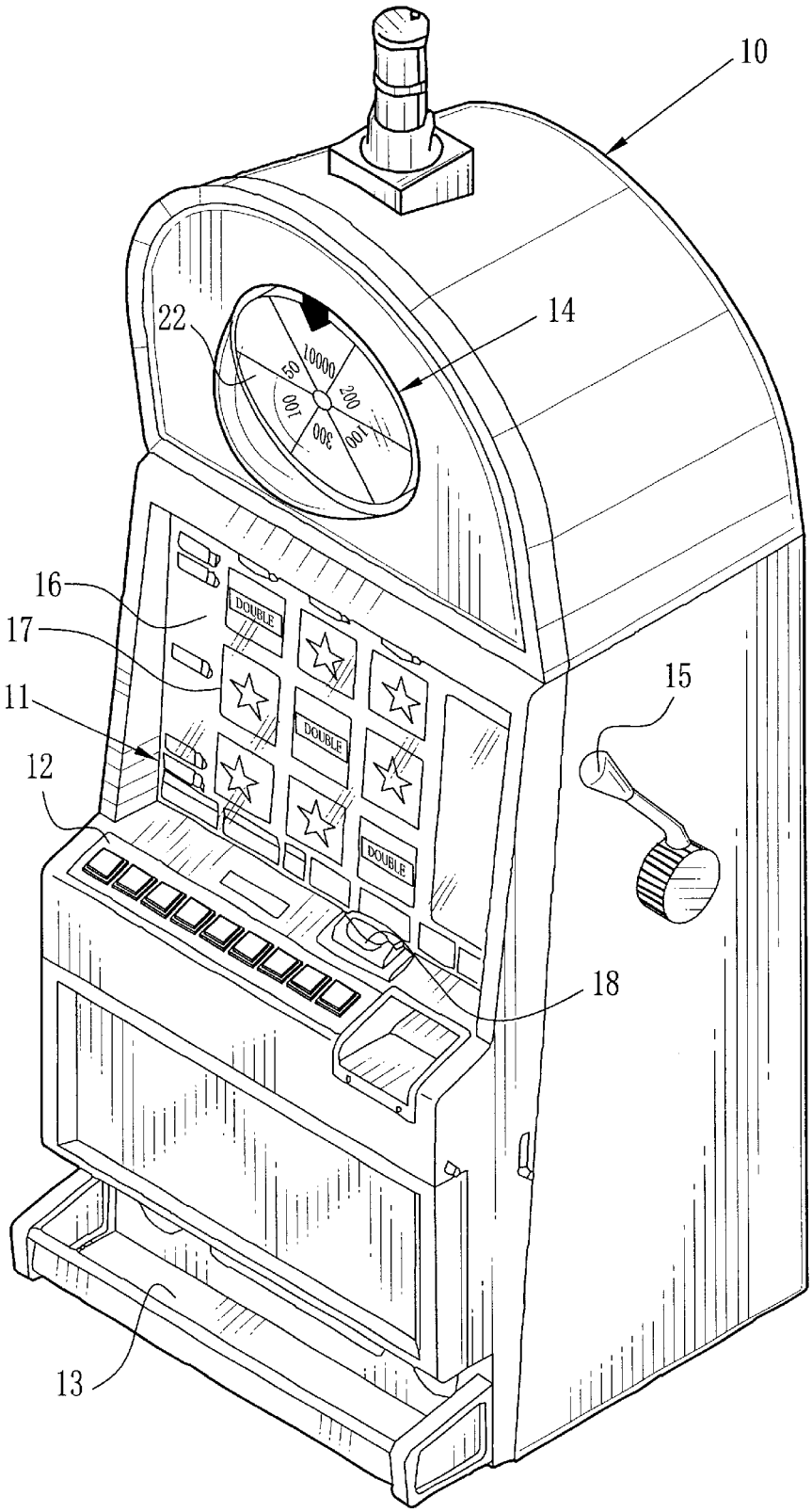
FIG. 1 is a perspective view of a slot machine including a symbol display device of the present invention, wherein a reel is set to a prize number determining position.

In FIG. 1, a front face of a slot machine 10 is provided with a first symbol display device 11, an operation panel 12, a coin receiver 13 and a second symbol display device 14. The first symbol display device 11 is used for a slot game, which is a main game, and the second symbol display device 14 is used for subsidiary games. As the subsidiary games there are a prize number determining game and a double-up game.

The first symbol display device 11 includes a LCD panel 16. The LCD panel 16 is provided with nine symbol display windows 17. Three of the symbol display windows are arranged in both of vertical and horizontal directions on the LCD panel 16 respectively. In the symbol display windows 17 several symbol images are displayed independently. The symbol is, for example, number, letter, sign, design, character, illustration, picture and the like.

A side of the slot machine 10 is provided with a start lever 15. When the start lever 15 is operated, the symbol images are displayed so as to be continuously moving in the same direction in each of the symbol display windows 17. Further, there are eight judgment lines in combination of three of the symbol display windows 17. Namely, three judgment lines are predetermined in vertical and horizontal directions respectively, and two judgment lines are predetermined in a diagonal direction.

For performing the slot game, each of the judgment lines is activated by betting a coin (not shown). In order to bet the coin, the coin is inserted through a coin slot 18, and a bet button 12*a* provided in an operation panel 12 is depressed. Note that in the operation panel 12 there are also a pay out button 12*b* and a subsidiary game start button 12*c*. When the symbol combination for winning is complete on the activated judgment lines, the player wins the slot game and obtains dividend coins whose dividend number is fixed in accordance with a grade of the winning.

In the slot machine 10, "DOUBLE" is a special symbol image. When the player wins the slot game by arranging three of the special symbol images on the activated judgment line, the second symbol display device 14 is automatically actuated such that the player can perform the prize number determining game. In the prize number determining game, a prize number representing the number of the dividend coins is determined. In the prize number determining game, a reel 22 of the symbol display machine 14 is set to a prize number determining position as shown in FIG. 1.

Figure 2:
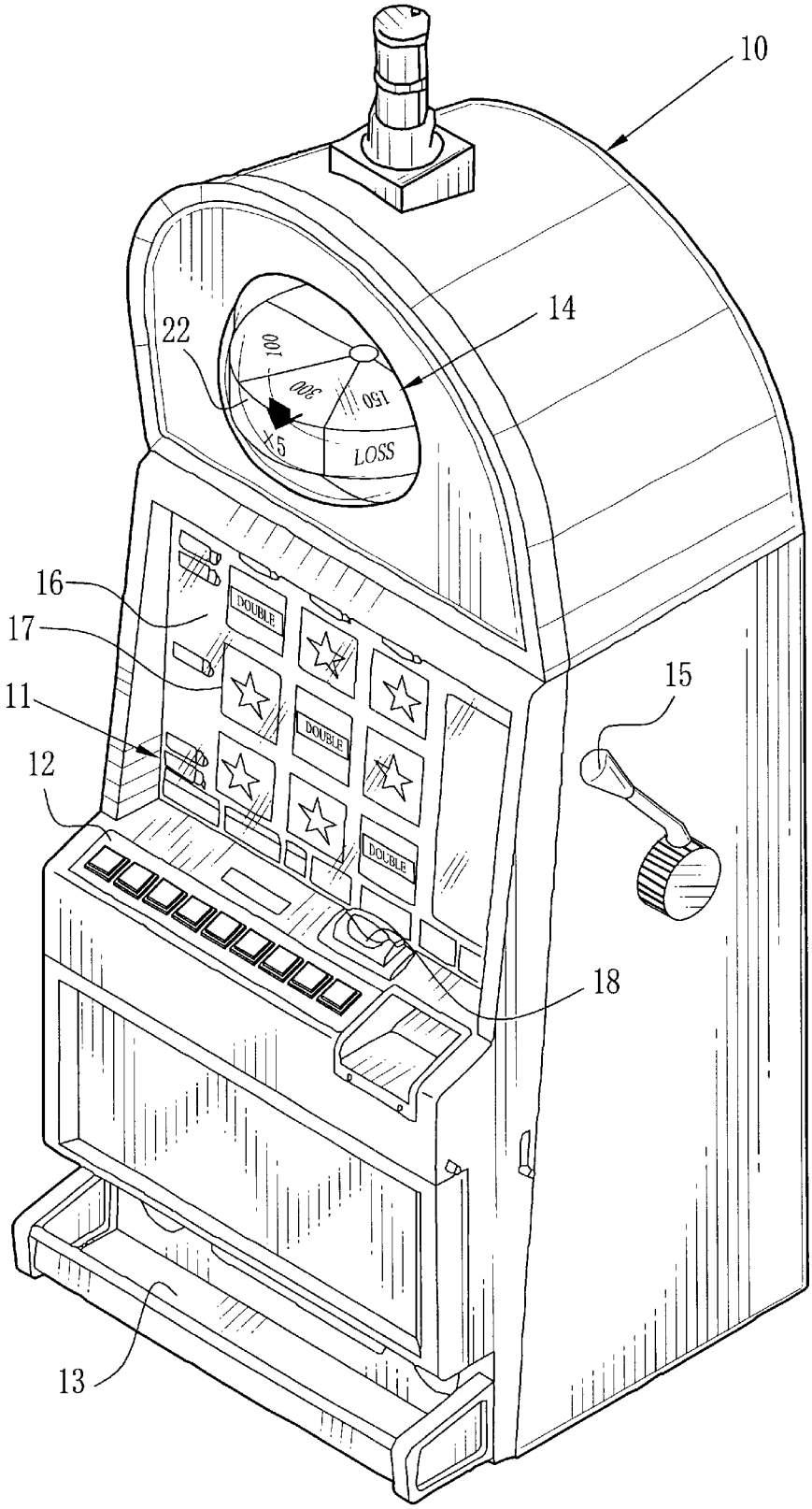
FIG. 2 is a figure the same as FIG. 1, wherein the reel is set to a multiplier determining position.

After determining the prize number in the prize number determining game, the player can select whether to perform the double-up game. When the performing of the double-up game is selected, as shown in FIG. 2, the reel 22 is rotated by 90° and set to a multiplier determining position to determine a multiplier to the prize number.

Figure 3:
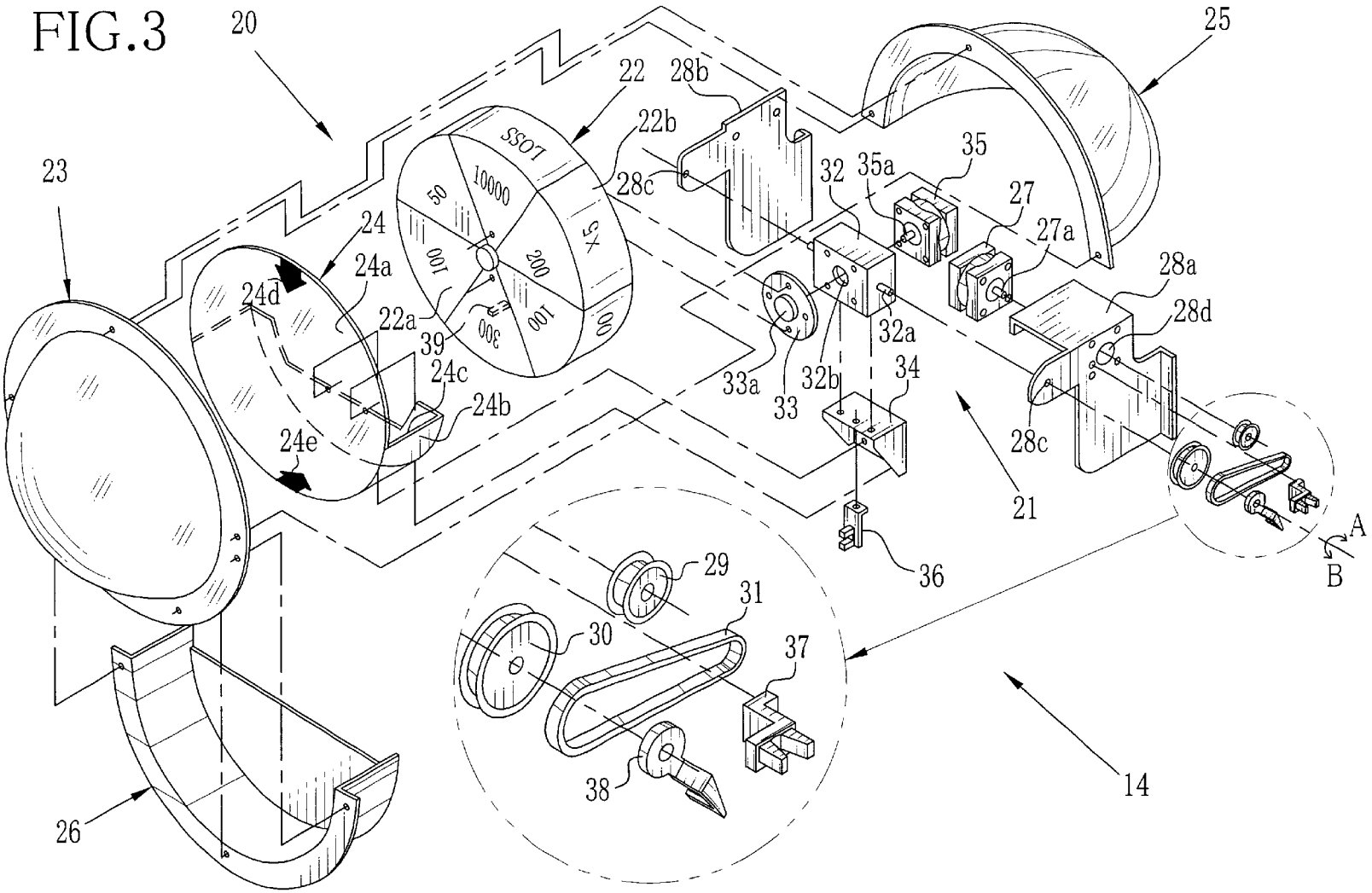
FIG. 3 is an explanatory perspective view of the symbol display device.

As shown in FIG. 3, the second symbol display device 14 includes a display section 20 and a reel drive section 21. The display section 20 is constructed of the reel 22, a hemispherical front cover 23, a reel cover 24, a quarter-spherical upper-rear cover 25 and a lower-rear cover 26. The reel 22 is a cylinder which cross section is channel-shaped.

The front cover 23, the upper- and lower-rear covers 25, 26 are fixed on an inside of the slot machine 10 with screws 10*a* (See, FIGS. 4 and 5) so as to surround the reel 22 and the reel cover 24. The front cover 23 is in the formed of a transparent plastic. A spherical part of the front cover 23 protrudes out after attachment to the slot machine 10. On the upper- and lower-rear covers 25, 26, some images are printed such that the inside of the slot machine 10 cannot be seen by the player while the reel 22 is set in a multiplier determining position.

The reel 22 has a first display portion 22*a* on a side surface thereof and a second display portion 22*b* on a periphery thereof. The first display portion 22*a* is used for the prize number determining game, and the second display portion 22*b* is used for the double-up game. On the first display portion 22*a* and the second display portion 22*b*, plural symbols are printed for determining the prize number and the multiplier. For example, as the symbols there are numerals 50, 100, 200, 300, and 10000 on the first display portion 22*a*, and LOSS, ×2, ×5, ×10 and ×100 on the second display portion 22*b*. Note that the symbol "LOSS" means that the player cannot obtain the dividend coins. Further, the symbols may be sign, pattern, character and the like.

The reel cover 24 is constructed of a first display surface 24*a*, a second display surface 24*b* and a reel pocket 24*c*. The reel pocket 24*c* has a diameter slightly longer than the reel 22 for holding the reel 22. When the reel pocket 24*c* holds the reel 22, the first and the second display surface 24*a*, 24*b* confront to the first display portion 22*a* and the periphery 22, respectively. The first display surfaces 24*a* and the second display surfaces 24*b* have a first pointer 24*d* and a second pointer 24*e*. The first pointer 24*d* points one of the symbols on the first display portion 22*a* as the prize number. The second pointer 24*e* points one of the symbols on the second display portion 22*b* as the multiplier.

The reel drive section 21 is constructed of a shift motor 27, brackets 28*a*, 28*b*, a small pulley 29, a large pulley 30, a toothed belt 31, a motor holder case 32, a flange 33, a reel cover supporter 34, a rotation motor 35, sensors 36, 37, and fragments 38, 39.

Figure 4:
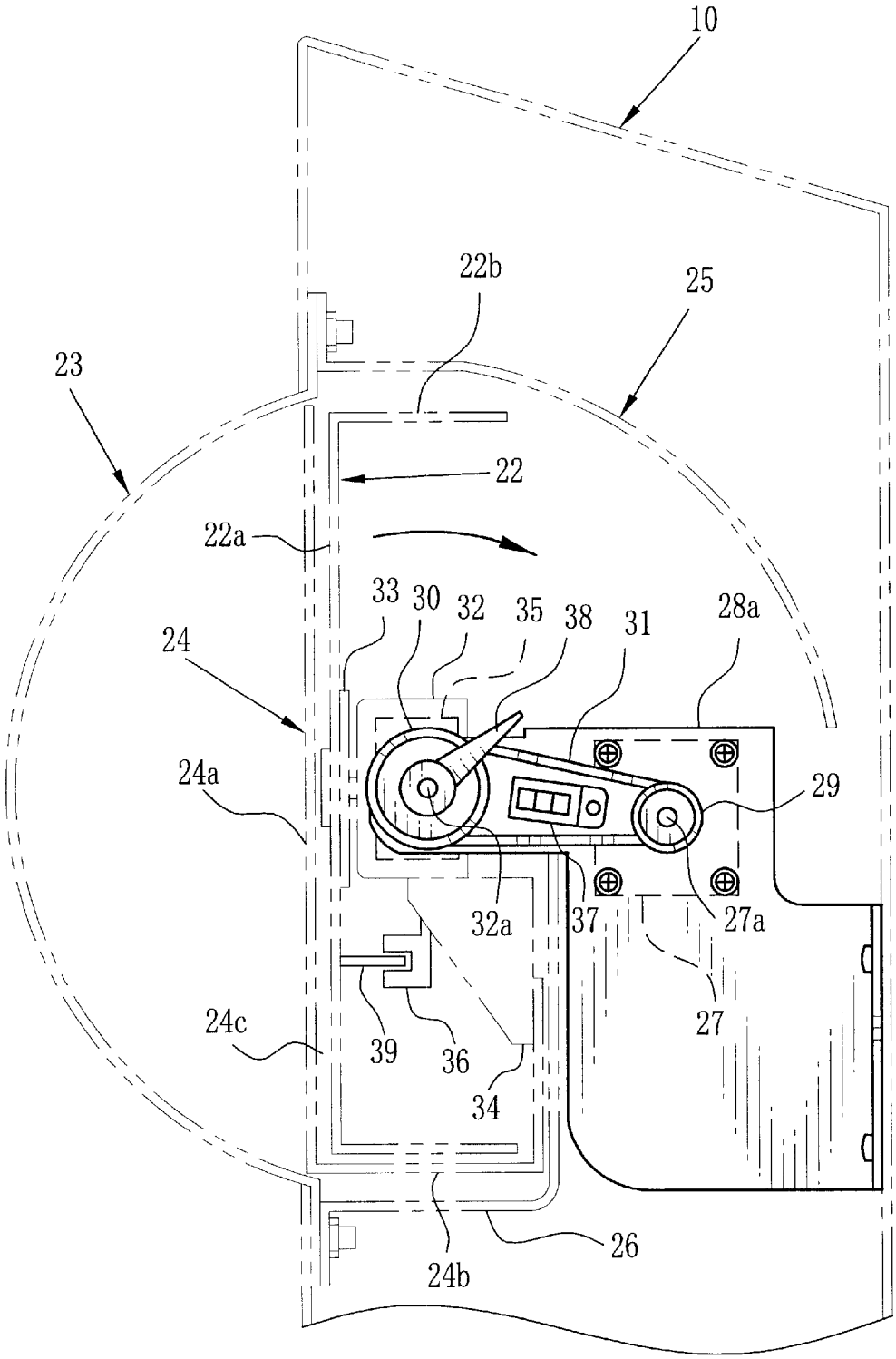
FIG. 4 is a side view of a bracket, illustrating a positional relation between a fragment and a sensor when the reel is set to the prize number determining position.
Figure 5:
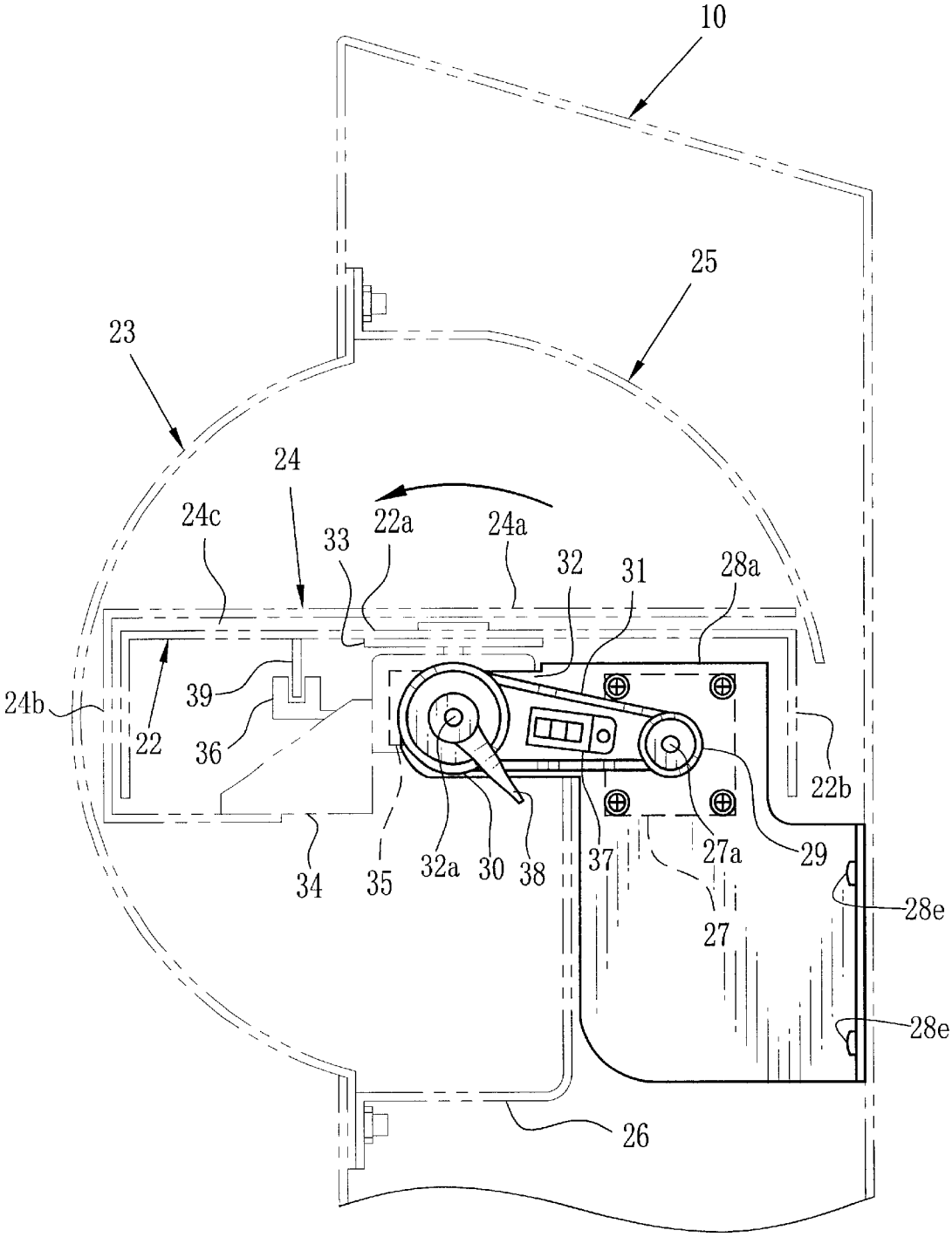
FIG. 5 is a figure the same as FIG. 4, wherein the reel is set to the multiplier determining position.

The brackets 28*a*, 28*b* are fixed to each other with screws (not shown), and fixed to the slot machine 10 with screws (see, FIGS. 4 and 5). In the brackets 28*a* a hole 28*c* is formed. In the hole 28*c* a shaft 32*a* provided for the holder case 35 is inserted to be rotatable.

The holder case 32 is box-like-shaped. In the holder case 32, the rotation motor 35 is attached. In a front face of the holder case 32, an opening 32*b* is formed. Through the opening 32*b* a drive shaft 35*a* of the rotation motor 35 is inserted, and an end portion of the drive shaft 35*a* is attached to the flange 33. A front side of the flange 33 has a reel attachment portion 33*a* through which the flange 33 is attached to the reel 22. Accordingly, the rotation motor 35 rotates the flange 33 and therefore also rotates the reel 22.

A bottom of the holder case 32 is provided with the reel cover supporter 34, and the reel cover supporter 34 is fixed to the reel cover 24 by screws (not shown). To the reel cover supporter 34 the sensor (photo interrupter) 36 is attached for detecting once the fragment 39 provided on rear side of the reel 22 when the reel 22 rotates.

The shift motor 27 is a stepping motor and attached to the bracket 28*a* with screws (not shown). In the bracket 28*a*, an opening 28*d* is formed, and through the opening 28*a* a drive shaft 27*a* of the shift motor 27 is inserted. To the drive shaft 27*a* is attached the small pulley 29 which is connected through the toothed belt 31 with the large pulley 30. The large pulley 30, which is firmly attached to the shaft 32*a*, is inserted through the hole 28*c* of the bracket 28. Further, the fragment 38 is firmly attached to the shaft 32*a*. The sensor (photo interrupter) 37 for detecting the fragment 38 is attached to the bracket 28 with screws (not shown). When the shift motor 27 drives, the holder case 32 and the fragment 38 is swung in the directions A and B through the large pulley 30, the toothed belt 31 and the holder case 32.

In accordance with the rotation of the holder case 32, the reel 22 and the reel cover that are fixed to the holder case 32 shift between the prize number determining position and the multiplier determining position. As shown in FIG. 4, when the reel 22 and the reel cover 24 is set to the prize number determining position, the first pointer 24*d* appears. As shown in FIG. 5, when the reel 22 and the reel cover 24 are set to the multiplier determining position, the second pointer 24*e* appears. When the reel 22 shifts between the prize number determining position and multiplier determining position, the fragment 38 rotates to be detected by the sensor 37.

Figure 6:
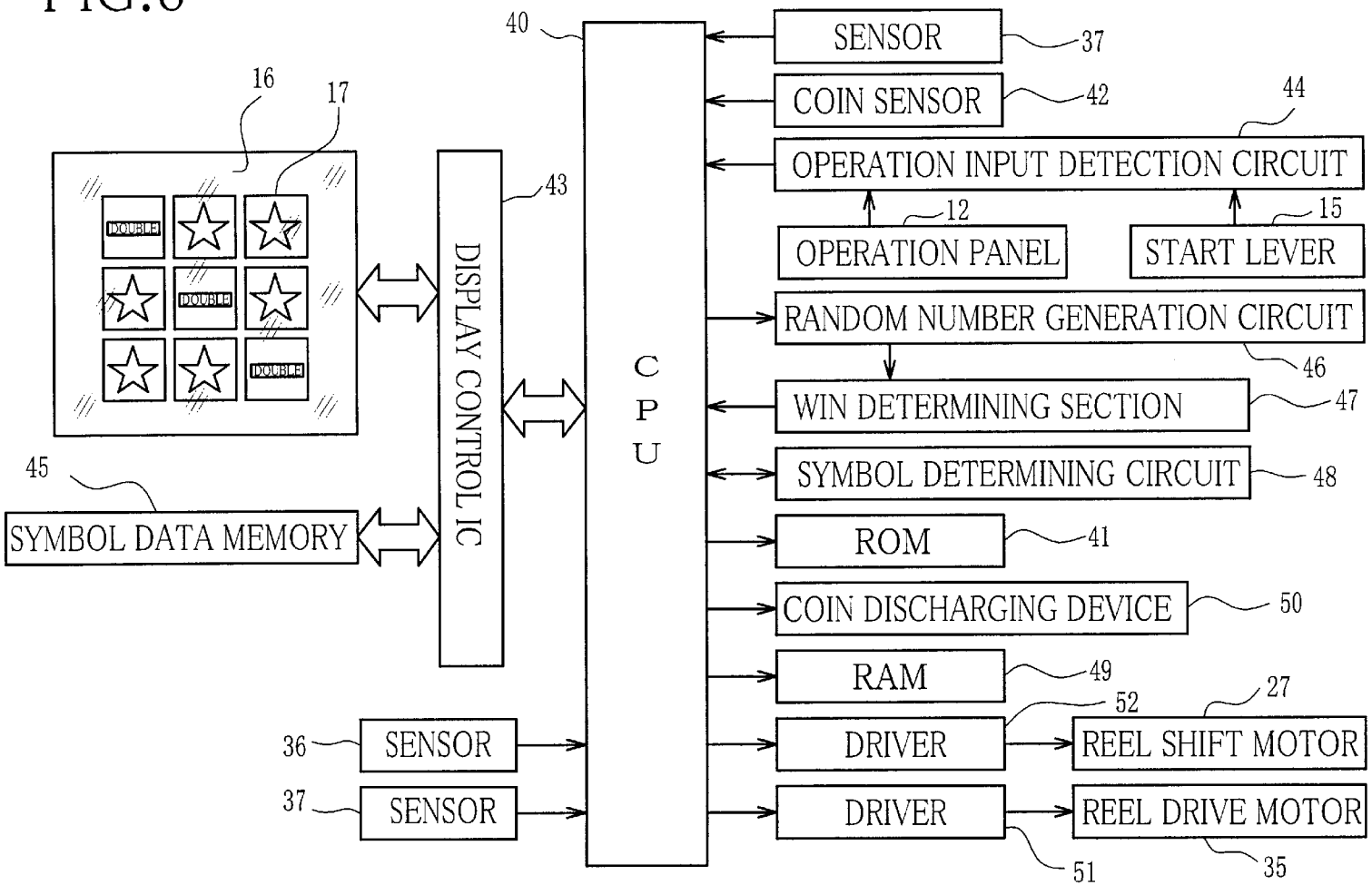
FIG. 6 is a block diagram of the slot machine.

As shown in FIG. 6, the drive of the slot machine 10 is controlled with a CPU 40. The CPU performs a game sequence based on a performing program for the slot game that is read out from a ROM 41. A coin sensor 42 is provided in an inner side of the coin slot 18, and generates a detection signal when detecting the correct coin. The detection signal is input in the CPU 40. The CPU 40 actuates a display control IC 43 corresponding to the detection signal. The display control IC 43 makes a credit window on the liquid crystal display panel 16 display how many coins are inserted into the slot machine 10.

When each of the buttons of the operation panel 12 is depressed, an operation signal is sent from an operation input detection circuit 44 to the CPU 40. Further, when the start lever 15 is operated, a start signal is input to the CPU 40, and the CPU 40 drives the display control IC 43 corresponding to the start signal. The display control IC 43 reads out a graphic data of the symbol images in accordance with each of the symbol display windows 17, and inputs the graphic data into the liquid crystal display panel 16 to simulate and display the moving of the symbol images.

Further, when the start signal is input into the CPU 40, one of the random numbers is generated by a random number generating circuit 46. The random number is input into a win determining section 47. Then the win determining section 47 determines the winning or the loss of the slot game and the kind thereof. A win determining signal or a loss determining signal is input into the CPU 40, in accordance with the kind of the winning and the loss.

The CPU 40 actuates a symbol determining circuit 48, responding to the win determining signal or the loss determining signal. The symbol determining circuit 48 determines the symbol image to be displayed in the respective symbol display window 17 and inputs into the CPU a determined first address corresponding to the determined symbol image 40.

The graphic data of each of the symbol display window 17 is input into the LCD panel 16 so as to display the moving of the symbol image. Thereby the display control IC 43 inputs into the CPU 40 the regulation first address shared to the symbol images. By observing the regulation first address, the CPU 40 can discriminates what symbol image is displayed in each of the symbol display window 17. When the determined first address input from the symbol determining circuit 48 and the regulation first address input from the display control IC 43 are the same, the movement of the symbol images is stopped. In each of the symbol image window 17, the symbol image corresponding to the determined first address is displayed.

In order to make the difference of the timing of inputting the determined first address of the graphic data and the timing of displaying the symbol image corresponding the regulation first address in the symbol image window 17 smaller, the display control IC 43 observes the velocity of the moving of the symbol image in the symbol image window 17, based on a count number of the clock pulse.

When the player wins the slot game, the CPU 40 refers a data of the dividend number recorded in the ROM 41 to specify the dividend number corresponding to the grade of the winning, stores in the RAM 49 a total of the dividend number and drives the display control IC 43 to display the total of the dividend number on a credit display window. When a pay button in the operation panel 12 is depressed, a coin discharging device 50 discharges the specified dividend number of the dividend coins. Note that when the bet button is depressed before the pay button for performing the next slot game, one of the judgment lines is activated each time without inserting the coin. In this case, the total of the dividend number decreased one by one.

The RAM 49 is used for temporarily storing several data generated in the process of the slot game, and has a memory area for recording an insertion number of the inserted coins. The RAM 49 further has a memory area for a credit counter calculating the total number of the discharged dividend coins and the like.

When the prize number determining game starts, the CPU 40 drives the rotation motor 35 through a driver 51, and after a predetermined time the rotation motor 35 stops. Thus the reel 22 is rotated to determine the prize number. Further, after stopping the rotation motor 35, the CPU 40 actuates the shift motor 27 through the driver 52 to shift the reel 22 from the prize number determining position to the multiplier determining position. Thereby the sensor 37 detects the fragment 38 to generate a shift detect signal, and the shift detect signal is input in the CPU 40. When receiving the shift detect signal, the CPU 40 discriminates that the reel 22 is shifting to the multiplier determining position, and stop the shift motor 27 after a predetermined time. While the data signal is not input, the shift motor 27 is continuously driven, and the shift motor 27 continuously rotates even after the passing of the predetermined time, something is broken. Therefore, the CPU 40 stops the shift motor 27.

While the reel 22 rotates in the subsidiary games, the sensor 36 detects the fragment 39 to generate a reset signal. The reset signal is input in the CPU 40. Thereby a counter for counting the drive pulse is reset. A data of the arrangement and kinds of the prize number and the multiplier and the number of the drive pulse to each of the symbol are stored in the CPU 40. Accordingly, the CPU 40 can discriminate the prize number pointed by the first pointer 24*d* and the pointed by second pointer 24*e*.

Figure 7:
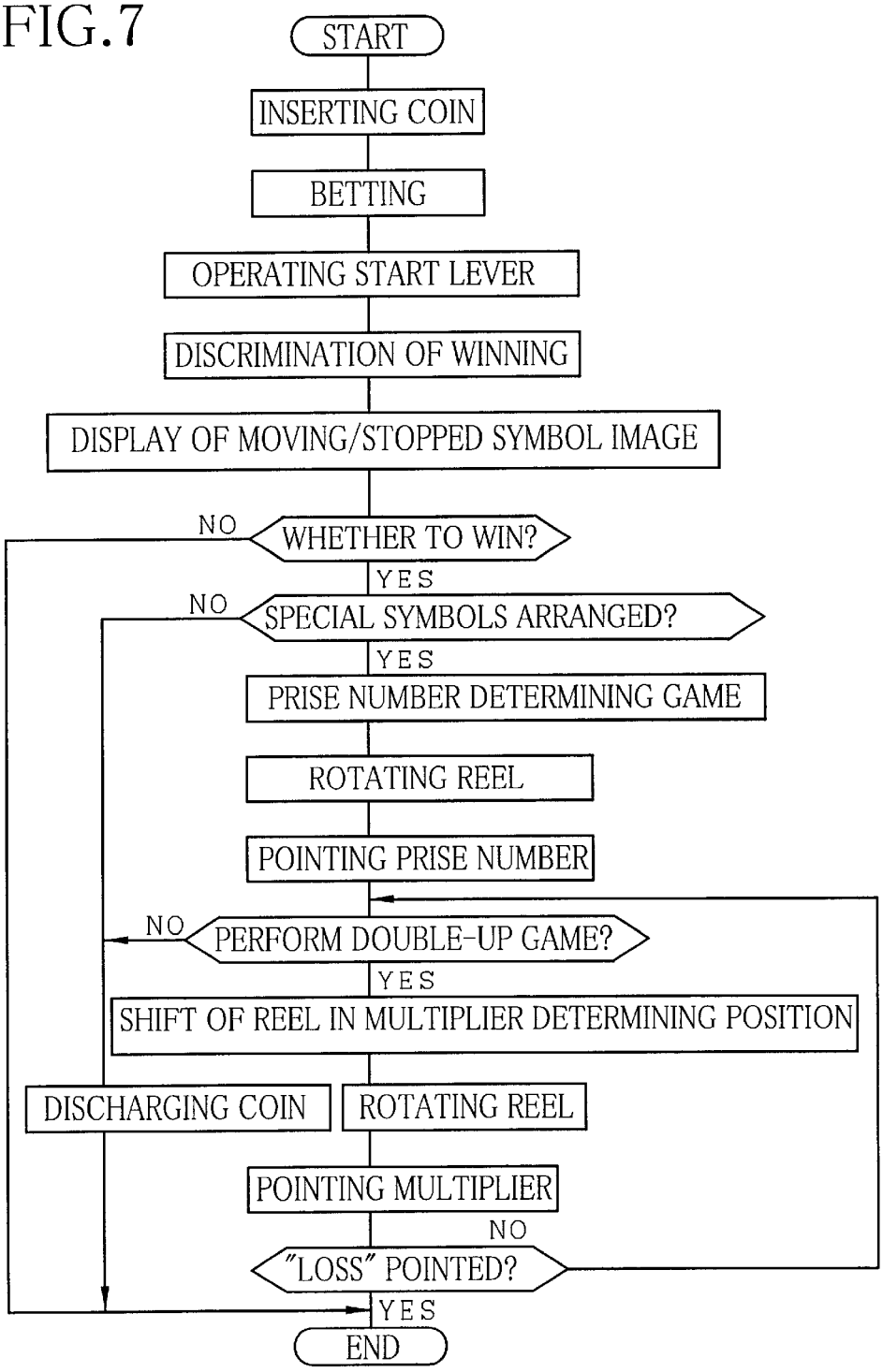
FIG. 7 is a flow chart illustrating a process of performing games of the slot machine.

Effects of the slot machine 10 will be described now with reference to FIG. 7. Before the slot game is performed, the reel 22 is set to the number display position. When the player inserts a coin into the coin slot 18, the coin detection signal is sent from the coin sensor 42 to the CPU 40. Then the player operates the bet button in the operation panel 12, the operation signal is input from the operation input detection circuit 44 to the CPU 40, and some judging lines are activated. The CPU 40 actuates the display control IC 43 responding to the operation signal. The display control IC 43 reads out the graphic data from a symbol data memory 45 to display a number of the betted coins (namely the activated judgment lines) in a bet number display window (not shown).

Thereafter, when the player operates the start lever 15, the start signal is input into the CPU 40. The CPU 40 actuates the random number generating circuit 46 corresponding to receive of the start signal 46. In the random number generating circuit 46, the sampling of the random number is carried out and the sampled random number is input into the win determining section 47. In the win determining section 47, it is determined whether and in what grade the player wins the slot game.

After determining in the win determining section, the display control IC 43 reads out the graphic data of symbol images for each of the symbol display window 17 from the symbol data memory 45 to display the moving of the symbol images on the LCD panel 16. Then the CPU 40 actuates the symbol determining circuit 48. The symbol discrimination device 48 specifies the symbol image to be displayed stationarily in the symbol display window 17, in accordance with the determination in the win determining section 47. After specifying the symbol image to be displayed, the CPU 40 stops through the display control IC the moving of the symbol image.

When the special symbols "DOUBLE" are in alignment on the activated judgment line, the CPU drives the drive motor 35 through the driver 51. Accordingly, the reel 22 is rotated to start the prize number determining game. When a predetermined time passes after starting the rotation of the reel 22, the reel 22 stops. The numeral pointed by the pointer 24*d* thereby becomes the prize number.

After the prize number is determined, the player can select whether to perform the double-up game by depressing the operation button in the operation panel 12. When it is designated not to perform the double-up game, the CPU 40 stores the prize number as the dividend number and actuates the display control IC 43 to display the total dividend number in the credit display window.

When the player selects to perform the double-up game, the CPU 40 drives the shift motor 27 through the driver 52.

When the shift motor 27 is driven, the reel 22 is set to the multiplier determining position. Thereby the sensor 37 detects the fragment 38, the detection signal is input in the CPU 40.

When the reel 22 is set to the multiplier determining position, the second pointer 24*e* of the reel cover 24 appears and the second display portion 22*b* of the reel 22 becomes observable. The CPU 40 drives the rotation motor 35 again to rotate the reel 22. Thus the double-up game is started. When the reel 22 stops after the predetermined time, the numeral on the second display portion 22*b* that is pointed by the second pointer 24*e* is regarded as the multiplier, and the dividend number is calculated by multiplying the multiplier to the prize number. Thereafter, the player can select whether he performs the double-up game again. Further, when the second pointer 24*e* points to the symbol "LOSS", the player loses the double-up game and loses the dividend coins, and the double-up game comes to an end.

The second symbol display device 14 may also be used only for the double-up game. In this case, sorts or arrangements of the symbols on the first display portion 22*a* and the second display portion 22*b* are different, and the player can select whether to use the first display portion 22*a* or the second display portion 22*b* before performing the double-up game. Further, the second symbol display device 14 may be used for games other than the prize number determining game and the double-up game, and in this case, symbol adequate for the game are arranged on the first display portion 22*a* and the second display portion 22*b*.

Furthermore, the timing of starting and stopping the drive of the first and second symbol display devices 11 and 14 is not restricted in the above embodiment. For example, the reel 22 of the second symbol display device 14 may begin to rotate before the drive of the first symbol display device 11. The subsidiary game may be performed also in the slot machine 10 when a predetermined number of the special symbols are displayed in the nine symbol display windows 17.

The drive shaft 27*a* of the shift motor 27 may be connected to the shaft 32*a* of the motor holder case 32, or interlocked to the shaft 32*a* through the link mechanism or gear mechanism. Further, instead of the toothed belt 31, a V-shaped belt or a chain may be also used, and further an adequate type of motor may be used as the shift motor 27, instead of the stepping motor.

The direction and the velocity of the rotation of the reel may be varied, and the illumination and the sounds may be produced in performance with the slot machine 10. The number of the symbol display windows 17 is not restricted to nine. Further, the number of the judging lines is not restricted to eight. These numbers may be adequately determined. Kinds, form, color and arrangement of the symbols are adequately determined. The order of the symbol display windows 17 to stop the moving of the symbol images is adequately determined and the method therefore is suitably set.

The slot machine 10 may include only the second symbol display device 14. In these cases, for example, characters are printed as the symbols on the reel 22, and the second symbol display device is a single display device in the other game machine. For performing with the other game machine, the player previously selects one of the characters. When the pointer 24*d* points the selected character, the player obtains the dividend coins, and can play the double-up game. Further, two kinds of games may be selectively performed, in each of which only the periphery or the side surface of the reel 22 is used. Furthermore, the reel 22 of the present invention may be used for a pachinko machine.

Various changes and modifications are possible in the present invention and may be understood to be within the present invention.

What is claimed is:

1. A symbol display device for a game machine, comprising:

a display member having a first display portion for a first game and a second display portion for a second game, said first and second display portions having first symbols and second symbols respectively;

a rotation drive means for rotating and stopping said display member in performing said first game and said second game; and a display shift means for shifting said display member between a first display position and a second display position, said first display portion being observable in said first display position, and said second display portion being observable in said second display position.

2. A symbol display device as claimed in claim 1, wherein said display member has a cylindrical reel, and a side surface of said reel is said first display portion and a periphery of said reel is said second display portion, and said reel is rotated around a center of said side surface.

3. A symbol display device as claimed in claim 2, wherein said side surface is perpendicular in the first display position, and said side surface is horizontal in the second display position.

4. A symbol display device as claimed in claim 3, further comprising a transparent reel cover covering at least a part of said reel, said reel cover being provided with a first pointer and a second pointer, said first pointer capable of pointing to one of said first symbols when said reel is in said first position, said second pointer capable of pointing to one of in said second symbols when said reel is in said second position.

5. A symbol display device as claimed in claim 4, wherein said reel cover shifts with said reel between said first position and said second position.

6. A symbol display device as claimed in claim 5, said rotation drive means comprising:

a first motor for rotating said reel; and a bracket for keeping said first motor swingable.

7. A symbol display device as claimed in claim 6, wherein a cross section of said reel has a channel shape, and said reel covers said bracket in said second display position.

8. A symbol display device as claimed in claim 7, wherein said display shift means includes a second motor for swinging said first motor in said bracket.

9. A symbol display device as claimed in claim 8, wherein said first and second motors are stepping motors.

10. A symbol display device as claimed in claim 1, wherein said second game is performed when predetermined conditions are filled in said first game.

11. A symbol display device as claimed in claim 1, wherein said symbol display device is used in a slot machine, and said first game and said second game is performed after a slot game.

12. A symbol display device as claimed in claim 1, wherein said first game and said second game are independently performed.

13. A symbol display device as claimed in claim 12, wherein said first symbols and said second symbols are not same.

* * * * *